US006673204B2

(12) United States Patent
Takai et al.

(10) Patent No.: US 6,673,204 B2
(45) Date of Patent: Jan. 6, 2004

(54) METHOD AND APPARATUS FOR MANUFACTURING NON-WOVEN FABRIC

(75) Inventors: Hisashi Takai, Kagawa (JP); Kazuya Okada, Kagawa (JP); Takayoshi Konishi, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 10/001,886

(22) Filed: Nov. 16, 2001

(65) Prior Publication Data

US 2002/0100153 A1 Aug. 1, 2002

(30) Foreign Application Priority Data

Nov. 27, 2000 (JP) ..... 2000-358777

(51) Int. Cl.[7] ..... D21F 11/00; D21H 13/00

(52) U.S. Cl. ..... 162/115; 162/109; 28/104; 28/105; 28/116

(58) Field of Search ..... 162/115, 109; 28/104, 105, 116

(56) References Cited

U.S. PATENT DOCUMENTS

| | | | | |
|---|---|---|---|---|
| 4,718,152 | A | 1/1988 | Suzuki et al. | 28/104 |
| 5,301,401 | A | 4/1994 | Suzuki et al. | 28/167 |
| 5,632,072 | A | 5/1997 | Simon et al. | 26/69 R |
| 5,761,778 | A | 6/1998 | Fleissner | 28/104 |
| 5,960,525 | A | 10/1999 | Fleissner | 28/104 |

FOREIGN PATENT DOCUMENTS

| | | | |
|---|---|---|---|
| EP | 0926288 | 6/1999 | D04H/1/46 |
| EP | 0972873 | 1/2000 | D04H/1/46 |
| EP | 1138474 | 10/2001 | B32B/5/26 |
| WO | 93/20272 | 10/1993 | D04H/1/44 |
| WO | 97/42366 | 11/1997 | D04H/1/46 |
| WO | 99/19551 | 4/1999 | D04H/1/54 |
| WO | 01/71081 | 9/2001 | D04H/13/00 |

*Primary Examiner*—Steven P. Griffin
*Assistant Examiner*—Mark Halpern
(74) *Attorney, Agent, or Firm*—Darby & Darby

(57) ABSTRACT

Disclosed are a method and an apparatus for manufacturing a non-woven fabric, in which a predetermined pattern of a forming body is transferred to a non-woven fabric immediately after or simultaneously with its formation by urging the non-woven fabric onto the forming body with water jets.

8 Claims, 8 Drawing Sheets

METHOD AND APPARATUS FOR MANUFACTURING NON-WOVEN FABRIC

BACKGROUND OF THE INVENTION

1. Field of the Invention

The present invention relates generally to a method and an apparatus for manufacturing a spunlaced non-woven fabric (fiber-entangled non-woven fabric). More particularly, the invention relates to a method and an apparatus for manufacturing a non-woven fabric, which can form a predetermined pattern on a surface of the non-woven fabric.

2. Description of the Related Art

Conventionally, on-woven fabrics have been used as wet tissue paper, cleansing tissue paper, wiping sheet for comfortably wiping baby's hip, cleaning sheet and so forth, which are brought into direct contact with the human skin or hand, and therefore require soft feeling and pleasant contact feeling.

Therefore, conventionally, relatively soft spunlaced non-woven fabrics have been widely used as such sheets. The spunlaced non-woven fabric is preferably processed to have protrusions and recesses arranged in a predetermined pattern so as to provide bulkiness for easy holding by hand or so as to improve cleaning effect. In the prior art, generally, such protrusions and recesses arranged in a predetermined pattern are formed by clamping a spunlaced non-woven fabric in a dry condition between a pair of heated embossing rolls so that the pattern of the embossing rolls is transferred to the non-woven fabric by heat and pressure.

However, in case where the spunlaced non-woven fabric is patterned in a dry condition by heating and pressing it with the heated embossing rolls, the non-woven fabric tends to restore its original flat surface when wetted with liquid or water. Therefore, the difference in level between the protrusions and recesses of the patterned surface may be reduced so that the pattern may fade or completely disappear. In this case, moreover, large tension force is locally applied to the non-woven fabric thus clamped between the embossing rolls to thereby enlarge the distance (gap) between adjacent fibers. Therefore, the fiber density is locally lowered to form thin portions in the non-woven fabric. This results in decreasing bulkiness and tensile strength.

Here, moisture may be applied to the non-woven fabric which has been once dried for transferring the pattern of the embossing rolls to the wet non-woven fabric by heating and pressing it with the embossing rolls. However, even in this case, similarly to embossing under a dry condition, the non-woven fabric in a wet condition may be locally stretched to locally lower the fiber density as set forth above.

SUMMARY OF THE INVENTION

The present invention has been worked out in view of the problem set forth above. Therefore, it is an object of the present invention to provide a method and an apparatus for manufacturing a non-woven fabric, whereby a predetermined pattern can be transferred without lowering strength of the non-woven fabric and the pattern transferred to the non-woven fabric can be well maintained even upon use in a wet condition.

According to a first aspect of the present invention, there is provided a manufacturing method of a non-woven fabric comprising the steps of:

forming a fibrous web on an outer peripheral surface of a wire net transporting belt circulating;

forming a non-woven fabric by applying water jets to the fibrous web on the outer peripheral surface of the wire net transporting belt for entangling fibers; and transporting the non-woven fabric to be opposed to a forming body having a predetermined pattern, and applying water jets to the non-woven fabric from the side of an inner peripheral surface of the wire net transporting belt or another wire net transporting belt following the wire net transporting belt for urging the non-woven fabric onto the forming body for transferring the pattern of the forming body to the non-woven fabric.

According to a second aspect of the present invention, there is provided a manufacturing method of a non-woven fabric comprising the steps of:

forming a fibrous web on an outer peripheral surface of a wire net transporting belt circulating; and transporting the fibrous web to be opposed to a forming body having a predetermined pattern, and applying water jets to the fibrous web from the side of an inner peripheral surface of the wire net transporting belt for urging the fibrous web onto the forming body for entangling fibers of the fibrous web for forming a non-woven fabric and in conjunction therewith for transferring the pattern of the forming body to the non-woven fabric.

In each manufacturing method, the forming body may be a member having a plurality of openings, and a pattern of the openings may be transferred to the non-woven fabric. Alternatively, the forming body may be a net, and a pattern of the net may be transferred to the non-woven fabric.

In the fibrous web forming step, preferably, a raw material, in which the fibers are mixed with a liquid, is provided on the wire net transporting belt. The manufacturing method may further comprise a drying step for drying the non-woven fabric having the pattern transferred thereto.

According to a third aspect of the present invention, there is provided a manufacturing apparatus of a non-woven fabric comprising:

a wire net transporting belt circulating;

fiber supply me ns for supplying material fibers on an outer peripheral surface of the wire net transporting belt and forming a fibrous web on the outer peripheral surface of the wire net transporting belt;

first water jet means for applying water jets to the fibrous web from the side of the outer peripheral surface of the wire net transporting belt for entangling the fibers of the fibrous web and forming a non-woven fabric;

a forming body having a predetermined pattern to be opposed to the non-woven fabric on the outer peripheral surface of the wire net transporting belt; and second water jet means for applying water jets to the non-woven fabric from the side of an inner peripheral surface of the wire net transporting belt for urging the non-woven fabric onto the forming body for transferring the pattern to the non-woven fabric.

According to a fourth aspect of the present invention, there is provided a manufacturing apparatus of a non-woven fabric comprising:

a wire net transporting belt circulating;

fiber supply means for supplying material fibers on an outer peripheral surface of the wire net transporting belt and forming a fibrous web on the outer peripheral surface of the wire net transporting belt;

a forming body having a predetermined pattern to be opposed to the fibrous web on the outer peripheral surface of the wire net transporting belt; and water jet means for applying water jets to the fibrous web from the side of an inner peripheral surface of the wire net transporting belt for urging the fibrous web onto the forming body for entangling the fibers of the fibrous web for forming a non-woven fabric and in conjunction therewith for transferring the pattern to the non-woven fabric.

In each manufacturing apparatus, the forming body may be a drum or circulating belt having a plurality of openings on a surface thereof. Alternatively, the forming body may be a drum having a net on surface thereof or a circulating belt made of a net.

Preferably, the fiber supply means supplies a raw material, in which the fibers are mixed with a liquid, to the wire net transporting belt. The manufacturing apparatus may further comprise drying means located downstream of the forming body for drying the on-woven fabric having the pattern transferred thereto.

In the manufacturing method and apparatus of the present invention, the patter of the forming body is transferred to the non-woven fabric by applying water jets to the non-woven fabric, after or simultaneously with formation of the non-woven fabric. In the non-woven fabric thus patterned, the gap between adjacent fibers in the protrusions of the patterned non-woven fabric is no enlarged to thereby prevent the fiber density thereof from being locally lowered. Therefore, the pattern can be transferred while maintaining sufficient thickness over the entire sheet. As a result, the non-woven fabric having the pattern transferred thereto has sufficient strength.

On the other hand, if the pattern is transferred to the non-woven fabric in a wet condition and thereafter the non-woven fabric is dried, the patterned surface can be well maintained without causing flatting thereof. Also, since forming force of the patterned surface is applied by water jets to provide softness to both the protrusions and recesses of the patterned sheet, the resulting sheet can provide soft feeling as a whole. Furthermore, the patterned non-woven fabric once dried can be suitably used as wet sheet by wetting it again. This is because the difference in level between the protrusions and recesses of the patterned surface is restored by wetting it again, so that the pattern is emphasized in the wet condition as compared with that in the dry condition. Therefore, even in a wet condition, the patterned surface of the non-woven fabric can be well maintained.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the in invention, but are for explanation and understanding only.

In the drawings.

DETAILED DESCRIPTION OF THE EMBODIMENTS

The present invention will be discussed hereinafter in detail in terms of the preferred embodiments of the present invention with reference to the accompanying drawings. In the following description numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figure 1:
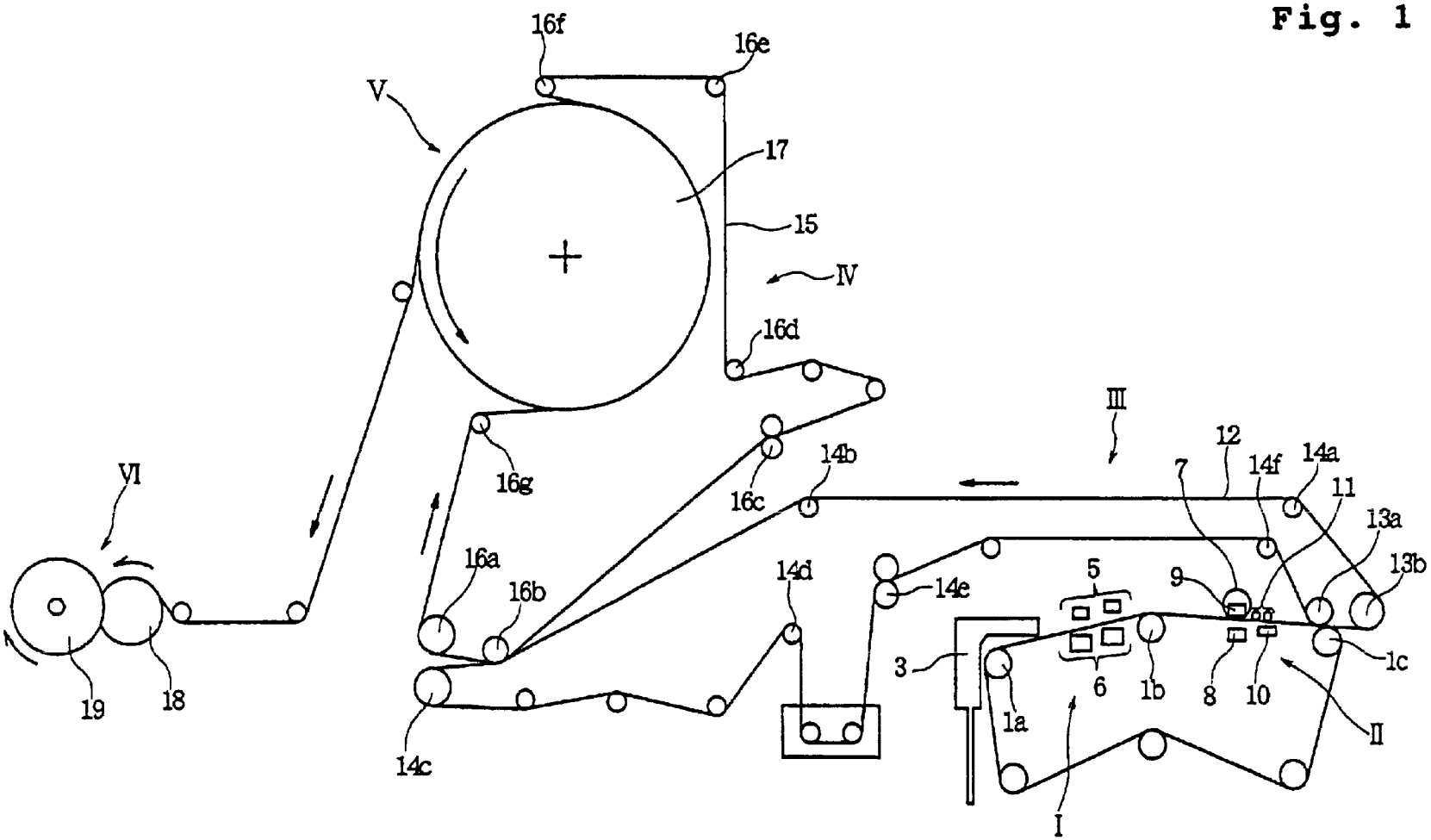
FIG. 1 is a diagrammatic illustration showing an overall construction of a non-woven fabric manufacturing apparatus according to a first embodiment of the present invention.
Figure 2:
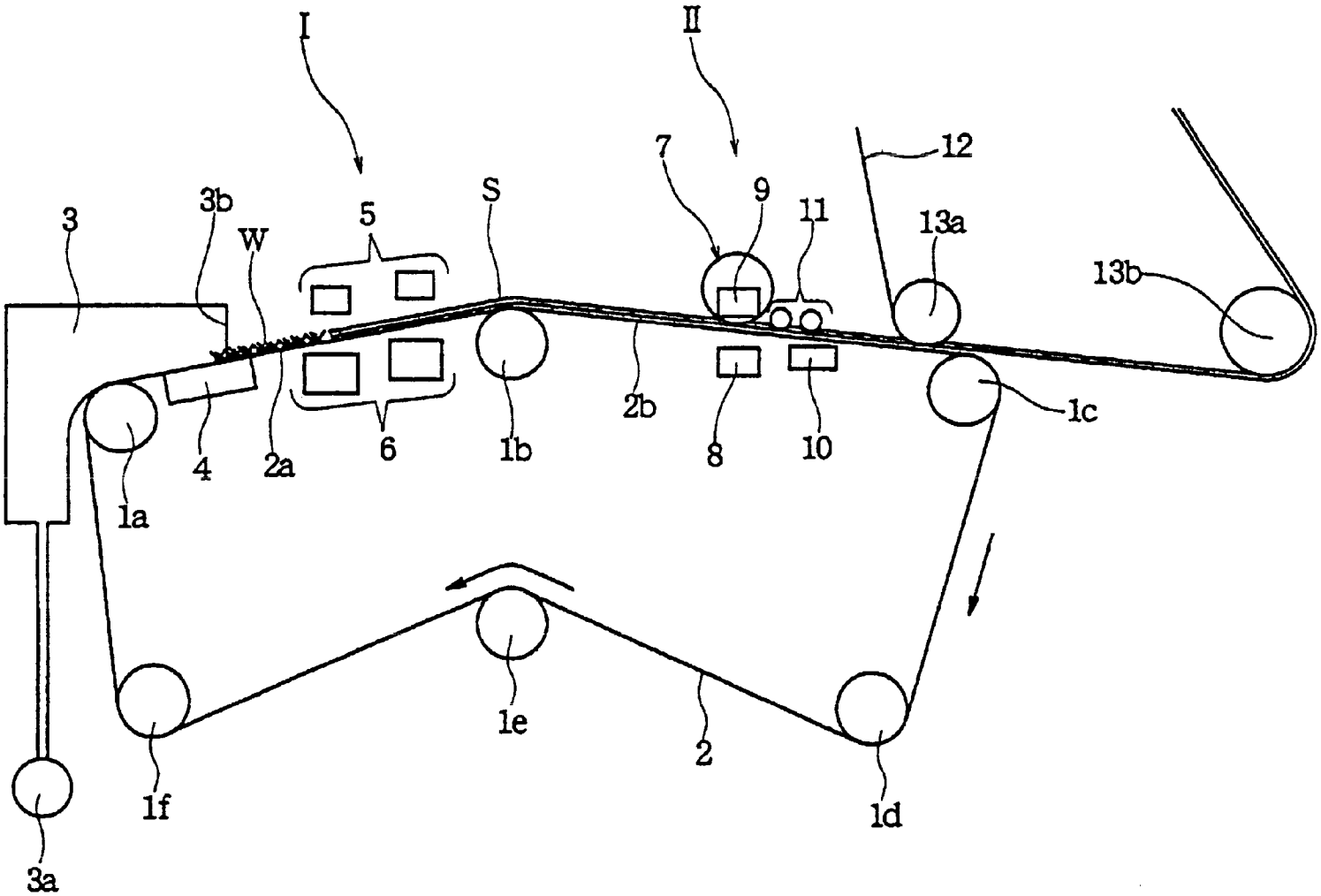
FIG. 2 is an enlarged illustration of a part of the manufacturing apparatus of FIG. 1.

FIG. 1 is a diagrammatic illustration showing an overall construction of a non-woven fabric manufacturing apparatus according to a first embodiment of the present invention, and FIG. 2 is an enlarged illustration of a part of the manufacturing apparatus of FIG. 1.

The non-woven fabric manufacturing apparatus shown in FIG. 1 has a non-woven fabric forming portion I, a pattern forming portion II, felt transporting portion III, a downstream side felt transporting and transfer portion IV, a drying portion V and take-up portion VI.

In the non-woven fabric forming portion I and the pattern forming portion II, a wire net transporting belt 2 wound over a plurality of rolls 1*a*, 1*b*, 1*c*, 1*d*, 1*e* and 1*f* is provided as shown in FIG. 2 in enlarged form. A driving force is applied to one of the rolls for driving the wire net transporting belt 2 for circulation in clockwise direction at a constant speed.

Between the roll 1*a* and 1*b*, the wire net transporting belt 2 has an ascending portion 2*a* which is tilted in ascending manner from the roll 1*a* to the roll 1*b*. On the upper side of the ascending portion 2*a*, a material supply portion (fiber supply means) 3 is placed in opposition to the outer peripheral surface of the wire net transporting belt 2; and on the lower side of the ascending portion 2*a*, a dewatering vessel 4 is placed in opposition to the inner peripheral surface of the wire net transporting belt 2. To the material supply portion 3, material fibers and water are supplied through a supply opening 3*a*. Material fibers may be any fibers suitable for forming spunlaced non-woven fabrics. For example, use can be made of natural fibers of ray in, synthetic fibers of polyethylene terephthalate (PET) or polypropylene (PP), and bicomponent synthetic fibers of polyethylene (PE) and PET or PP and PET.

By an air suction force of the dewatering vessel 4, the material fibers in the material supply portion 3 are drawn to the outer peripheral surface of the wire net transporting belt 2. In the material supply portion 3, a stopper member 3*b* called as hill slice is provided in opposition with the outer peripheral surface of the wire net transporting belt 2 across a gap. With the gap between the wire net transporting belt 2 and the stopper member 3*b*, forming of a fibrous web W of a predetermined thickness on the outer peripheral surface of the wire net transporting belt 2 is performed.

Between the roll 1*a* and 1*b*, a single stage or a plurality of stages of water jet nozzles 5 are provided in opposition to the outer peripheral surface of the wire net transporting belt 2; and suction boxes 6 are provided in opposition to the inner peripheral surface of the wire net transporting belt 2. Toward the fibrous web W formed on the wire net transporting belt 2 across the stopper member 3*b*, water jets are applied from the water jet nozzles 5. By water jets, fibers of the fibrous web W are entangled to form a spunlaced non-woven fabric S. In this embodiment, water jets are applied immediately after forming of the fibrous web W on the wire net transporting belt 2 to complete formation of the spunlaced non-woven fabric S on the wire net transporting belt 2.

Between the roll 1*b* and 1*c*, the wire net transporting belt 2 has a descending portion 2*b* which is tilted in descending manner from the roll 1*b* to the roll 1*c*. The pattern forming portion II is provide at the descending portion 2*b* to form a predetermined pattern on the spunlaced non-woven fabric S.

In the pattern forming portion II, a pattern drum 7 as a forming body is provided in opposition to the outer peripheral surface of the wire net transporting belt 2; and a single stage or a plurality of stages of water jet nozzles 8 are provided in opposition to the inner peripheral surface of the wire net transporting belt 2. Within the pattern drum 7, a suction box 9 is arranged for sucking water jetted from the water jet nozzles 8.

Figure 6:
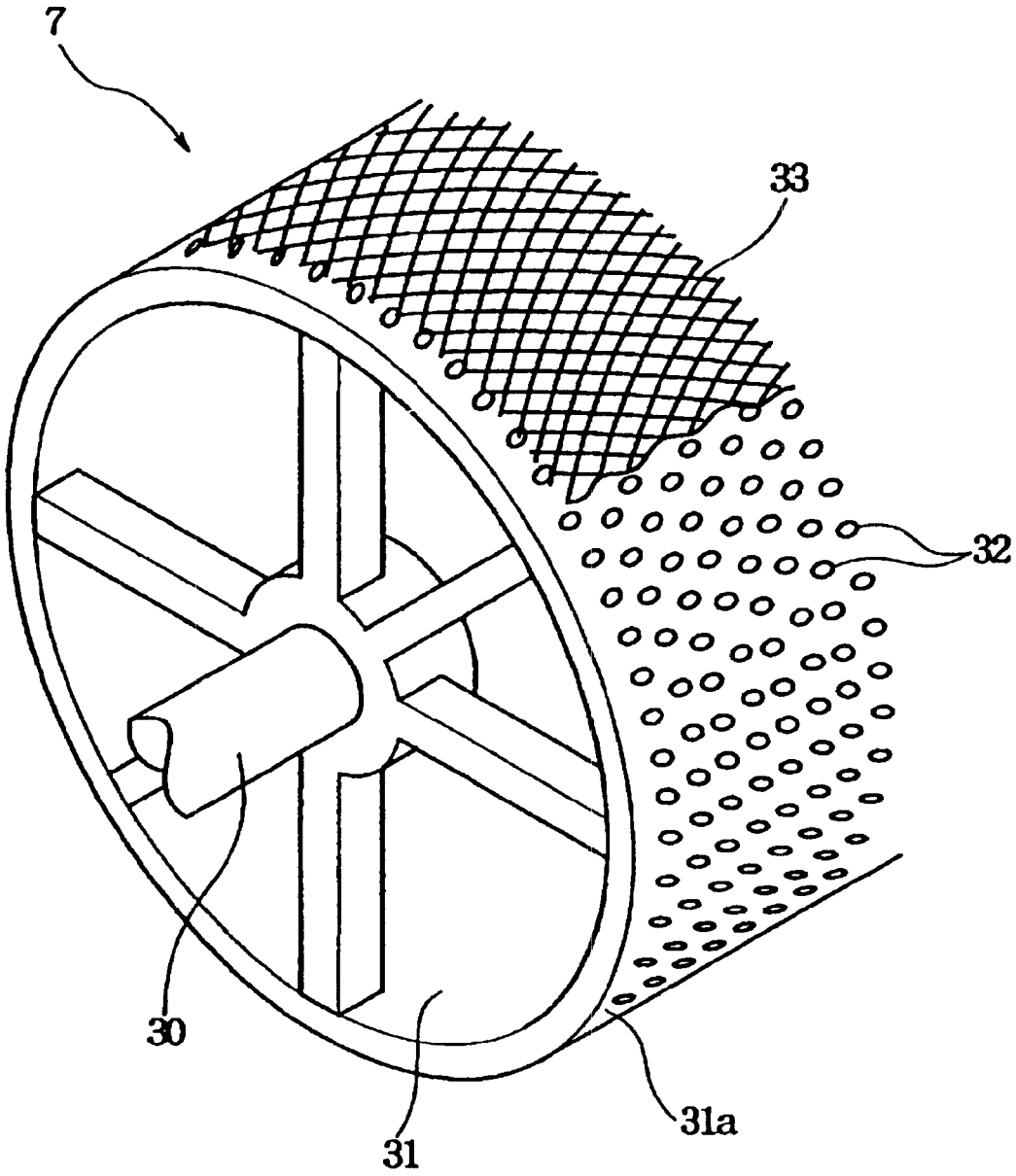
FIG. 6 is a perspective view showing one example of a pattern drum.
Figure 7:
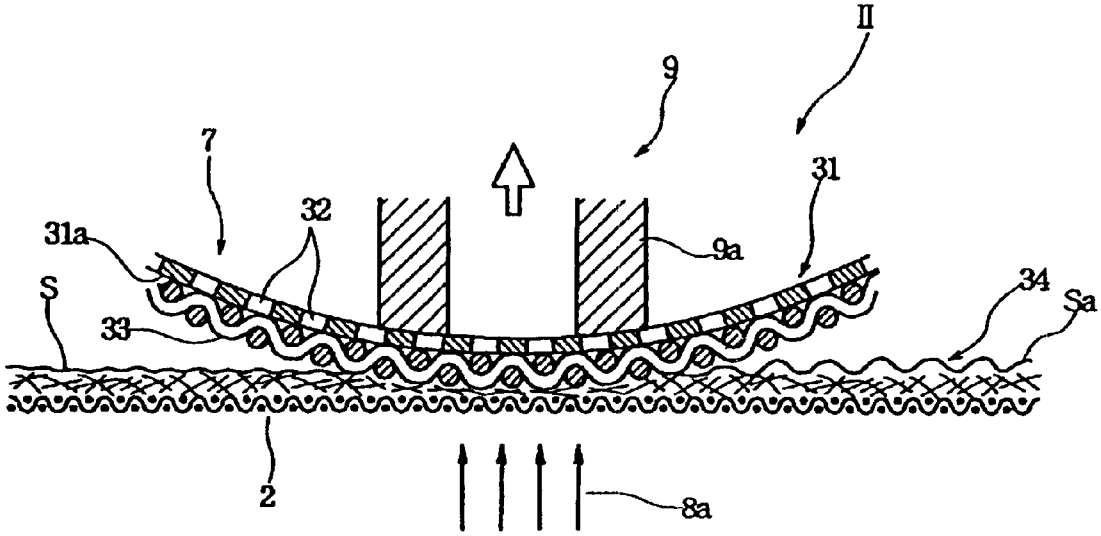
FIG. 7 is an enlarged section showing a portion of a pattern forming portion where the pattern drum and a wire net transporting belt are placed in opposition.

FIG. 6 is a perspective view showing one example of the pattern drum 7, and FIG. 7 is an enlarged section showing a portion where the pattern drum 7 and the wire net transporting belt 2 are placed in opposition with each other.

The pattern drum 7 has a drum body 31 rotatably about a shaft 30. The drum body 31 is formed with a large number of openings 32 which pass through it from the outer peripheral surface 31*a* to the inner peripheral surface. The large number of openings 32 are regularly or randomly arranged on the outer peripheral surface 3*a*. The open area of each opening 32 is sufficiently greater than that defined by mesh of the wire net transporting belt 2.

A net 33 is wound around the outer peripheral surface 31*a* of the drum body 31 to cover a region having the openings 32 arranged therein. The net 33 is formed by weaving meshes with use of plastic wires, metal wires, resin-coated metal wires or the like. Mesh of the net 33 is sufficiently larger than mesh of the wire net transporting belt 2.

As shown in FIG. 7, the suction box 9 provided inside of the pattern drum 7 has a seal member 9*a*, which slidingly contacts the inner peripheral surface of the drum body 31, and sucks air through the seal member 9*a* as shown by arrow.

When the spunlaced non-woven fabric S having been completed in the non-woven fabric forming portion I is transported to the pattern forming portion II by the wire net transporting belt 2, the pattern drum 7 is rotated in synchronism with transporting speed of the wire net transporting belt 2 so as to transport the spunlaced non-woven fabric S in a condition pinched between the wire net transporting belt 2 an the pattern drum 7. At this time, water jets 8*a* are jetted from the water jet nozzles 8 in opposition to the inner peripheral surface of the wire net transporting belt 2 to reach the non-woven fabric S through the wire net transporting belt 2. With a pressure of the water jets 8*a* and a suction force of the suction box 9, the non-woven fabric S is urged onto the pattern drum 7 to be tightly fitted thereon. At this time, the pattern of the net 33 is transferred on the surface of the non-woven fabric S to obtain a non-woven fabric sheet Sa having an uneven surface. Here, the pattern thus transferred is indicted at 34.

In the transfer process of the pattern 34, individual fibers of the non-woven fabric S are urged onto the net 33 while receiving a pressure of the water jets 8*a*. Therefore, the bulkiness of the non-woven fabric S can be well maintained even after the transfer of the pattern 34. In addition, the pattern 34 can be transferred without exerting excessive local tension force in the non-woven fabric. The non-woven fabric sheet Sa immediately after the pattern 34 has been transferred thereto is in a wet condition It should be noted that the pattern drum 7 shown in FIG. 6 may also be used in condition where the net 33 is removed. When the pattern drum 7 is used without the net 33, the spunlaced non-woven fabric S shown in FIG. 7 is subjected to the water jets 8*a* while being pinched between the outer peripheral surface 31*a* of the drum body 3 and the wire net transporting belt 2, so that the pattern of the openings 32 on the outer peripheral surface 31*a* of the drum body 31 is transferred as the pattern 34 on the surface of he non-woven fabric sheet Sa. In this case, the pattern 34 t be transferred to the non-woven fabric sheet Sa may be determined by arranging the openings 32 in an arbitrary pattern, such as a design pattern (e.g., polka-dot pattern) or a pattern depicting outline of character, on the outer peripheral surface 31*a* of the drum body 31. It is also possible that each opening 32 is of complex shape such as the shape of character, sign or the like. In this case, the surface of the non-woven fabric sheet Sa may be patterned with the shape of character, sign or the like.

It may also be possible to wind a punched plate or the like around the outer peripheral surface 31*a* of the drum body 31, in place of the net 33. The holes to be punched in the punched plate may be arranged in an arbitrary pattern, such as a design pattern (e.g., polka-dot pattern) or a pattern depicting outline of character, or may have complex shape, such as the shape of character, sign or the like, similarly to the outer peripheral surface 31*a* of the drum body 31.

As shown in FIGS. 1 and 2, on downstream side of the pattern drum 7, single or a plurality of rollers 11 are provided in opposition to the outer peripheral surface of the wire net transporting belt 2. On the other hand, a suction box 10 is provided in opposition to the inner peripheral surface of the wire net transporting belt 2. The non-woven fabric sheet Sa to which the pattern 4 has been transferred by urging the non-woven fabric S onto the pattern drum 7 is peeled off the pattern drum 7 by the presence of the rollers 11 and by the suction force of the suction box 10. At this time, the non-woven fabric sheet Sa is also dewatered by the suction box 10.

As shown in FIG. 1, to the wire net transporting belt 2, a felt transporting belt 12 of a felt transporting portion (felt part) III is contacted. The felt transporting belt 12 is a blanket cloth wove by needling system. Due to difference in roughness between the wire net transporting belt 2 and the felt transporting belt 2, the non-woven fabric sheet Sa formed on the wire net transporting belt 2 is transferred to the felt transporting belt 12.

In the felt transporting portion III, the felt transporting belt 12 is wound around rolls 13*a* and 13*b* in the vicinity of the wire net transporting belt 2. The roll 13*a* is offset from the roll 1*c* on the side of the wire net transporting belt 2 so as not to exert pressurizing force onto the non-woven fabric sheet Sa between the rolls 13*a* and 1*c* to avoid reduction of bulkiness of the non-woven fabric sheet Sa for not degrading soft touch feeling or softness.

The roll 13*a* is a transfer means utilizing air suction, namely suction pick-up roll to easily transfer the non-woven fabric sheet Sa to the felt transporting belt 12 from the wire net transporting belt 2. The suction pick-up roll is a net form roll and air is sucked therein. By using such suction pick-up roll, even if the rolls are not pressurized with each other at the contact portion between the wire net transporting belt 2 and the felt transporting belt 12, the non-woven fabric sheet Sa completed on the surface of the wire net transporting belt 2 is certainly transferred to the felt transporting belt 12.

In the felt transporting portion III, the felt transporting belt 12 is wound around the rolls 13*a*, 13*b* and other rolls 14*a*, 14*b*, 14*c*, 14*d*, 14*e*, 14*f* and so forth and is driven to circulate in counterclockwise direction by a rotation force applied to one of the rolls.

In the downstream side felt transporting and transfer portion IV, a second felt transporting belt 15 is provided. The felt transporting belt 15 is a blanket cloth woven by needling system similarly to the felt transporting belt 12, and is wound around plurality of rolls 16*a*, 16*b*, 16*c*, 16*d*, 16*e*, 16*f* and 16*g*. Between the rolls 16*f* and 16*g*, a drying drum 17 is accommodated in the felt transporting belt 15. The felt transporting belt 15 and the drying drum 17 are contacted only by tension force of the felt transporting belt 15 and no pressurizing structure of the roll and the drum is present therebetween.

The felt transporting belt 12 and the second felt transporting belt 15 are contacted on the left side in the drawing. Even in this contact portion, there is no pressurizing portion press portion) between the rolls. The felt transporting belt 12 and the felt transporting belt 15 are mainly contacted at the portion of the roll 16*b*, which is a suction pick-up roll serving as transfer means by air suction.

The second felt transporting belt 15 is circulated in clockwise direction by rotation force of one of the rolls 16*a*, 16*b* . . . or the drying drum 17. The non-woven fabric sheet Sa carried on the surface of the felt transporting belt 12, is transferred to the second felt transporting belt 15 by suction force of the roll 16*b*. Furthermore, the non-woven fabric sheet Sa is wrapped on the drying drum 17 of the drying portion V to be dried. The non-woven fabric sheet Sa as dried is taken up on a take-up roll 8 to complete manufacturing of a roll 19 of non-woven fabric.

A plurality of on-woven fabric rolls 19 thus completed is then used for manufacturing a wet sheet stack, for example. In this case, the non-woven fabric sheets Sa having the pattern 34 formed thereon are unwound from the rolls 19 and are then stacked one on another while being folded in two-ply or three-ply, for example, thereby to form a dry sheet stack. Thereafter, liquid such as chemical solution or water is applied to the dry sheet stack to form a wet sheet stack. Here, the sheet stack is cut into a predetermined length, before or after the application of liquid. The wet sheet stacks thus completed are individually packaged.

When the non-woven fabric sheet Sa to which the pattern 34 is transferred by the pattern forming portion II, is dried by the drying drum 17 the difference in level between the protrusions and recesses of the patterned surface may be reduced (i.e., the patterned surface may be flattened to some extent). However, since the pattern 34 is transferred in a wet condition by urging individual fibers onto the net or the like with water jets, when the non-woven fabric sheet Sa after dried is wetted again by application of liquid such as chemical solution or water, the flattened surface of the sheet Sa is restored to its original condition (i.e., the condition at the time of the transfer of the pattern 34), to emphasize the pattern 34.

Accordingly, when the non-woven fabric sheet Sa is wetted, its entire bulkiness can be increased to provide a sheet having soft feeling to the touch. Moreover, the patterned surface of the non-woven fabric sheet Sa thus wetted can improve the ability to wipe off fine dust or stains when used for cleaning or wiping operation.

In the manufacturing apparatus of the non-woven fabric shown in FIGS. 1 and 2 and in the manufacturing method using the manufacturing apparatus, the wet-formation of the fibrous web and the formation of the non-woven fabric by water jets are both completed on the wire net transporting belt 2 in the non-woven fabric forming portion (wet-forming portion) I; and the pattern formation is also completed on the same wire net transporting belt 2 in the pattern forming portion II, immediately after the formation of the non-woven fabric. This permits shortening of manufacturing line. However, it is of course possible to provide the pattern forming portion II on downstream side of the wire net transporting belt 2. For example, the felt transporting belt 12 may be replaced by another wire net transporting belt, and the pattern forming portion II may be provided between the rolls 14*a* and 14*b*.

Figure 3:
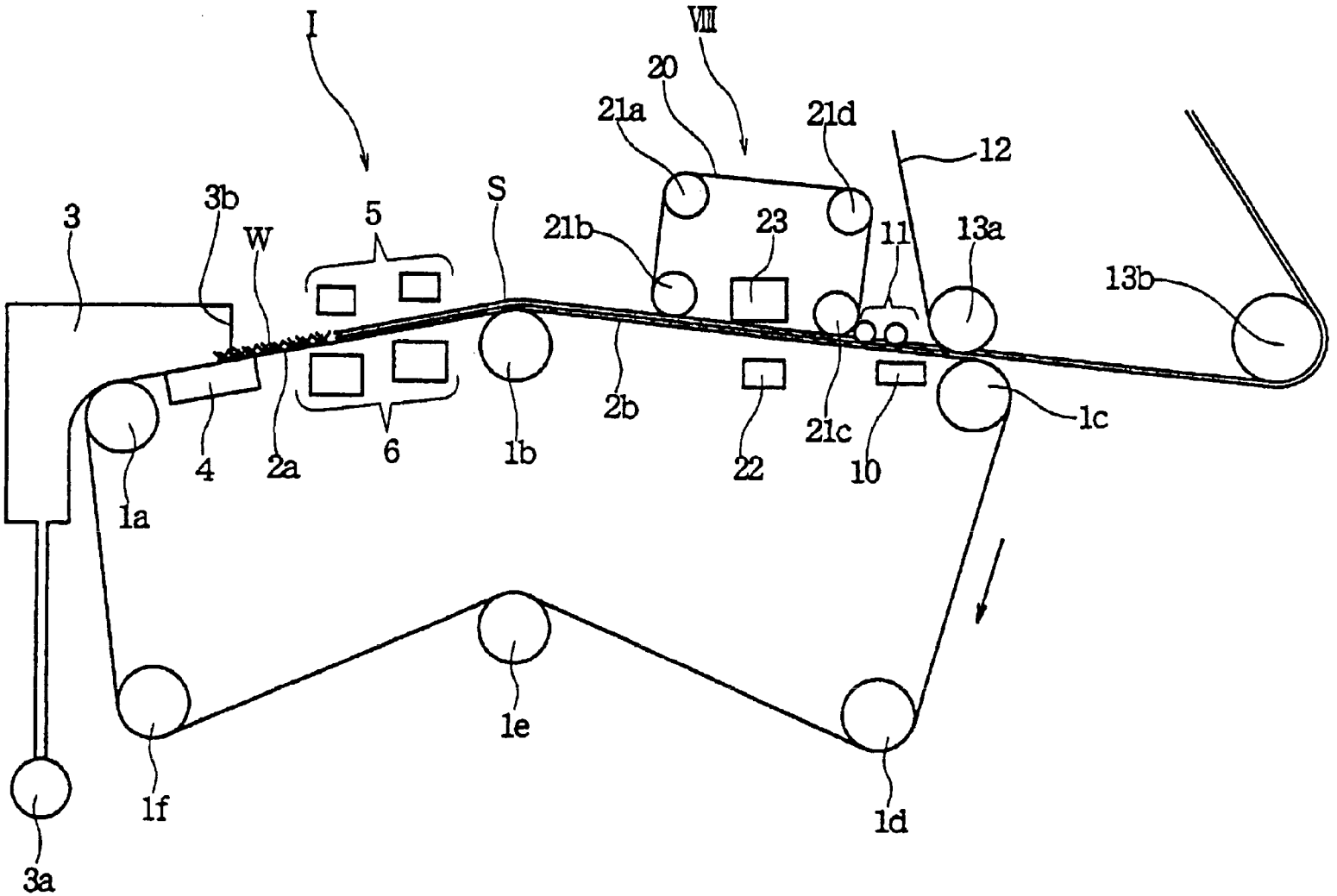
FIG. 3 is an enlarged partial illustration of a non-woven fabric manufacturing apparatus according to a second embodiment of the present invention.

FIG. 3 is an enlarged illustration showing a pattern forming portion VIII according to a second embodiment of the non-woven fabric manufacturing apparatus of the present invention. The non-woven fabric forming portion I shown in FIG. 3 is similar to that discussed in connection with FIG. 1. The other portions III, V, V and VI omitted from FIG. 3 are also similar to those discussed in connection with FIG. 1. Hereinafter, like reference numerals to those in FIG. 1 will identify like elements and detailed description of these common element would be eliminated in order to avoid redundant discussion for maintaining the disclosure simple enough to facilitate clear understanding of the invention.

In the second embodiment, the spunlaced non-woven fabric S is formed by the non-woven fabric forming portion I, and then, the pattern formation is performed by the pattern forming portion VIII. In the pattern forming portion VIII, a patterning wire (a circulating belt having a desirable pattern) 20 is provided as a forming body, in place of the pattern drum 7 used in the pattern forming portion II of FIGS. 1 and 2.

The patterning wire 20 is a net having the same pattern as that of the net 33 illustrated in FIGS. 6 and 7, and is wrapped over four rolls 21*a*, 21*b*, 21*c* and 21*d* in opposition to the outer peripheral surface of the wire net transporting belt 2. By rotatingly driving one of the rolls, the patterning wire 20 circulates in counterclockwise direction at a peripheral speed matching with the peripheral speed of the wire net transporting belt 2. Also, a single stage or a plurality of stages of water jet nozzles 22 are provided in opposition to the inner peripheral surface of the wire net transporting belt 2. Within the patterning wire 20, a suction box 23 is provided.

Figure 8:
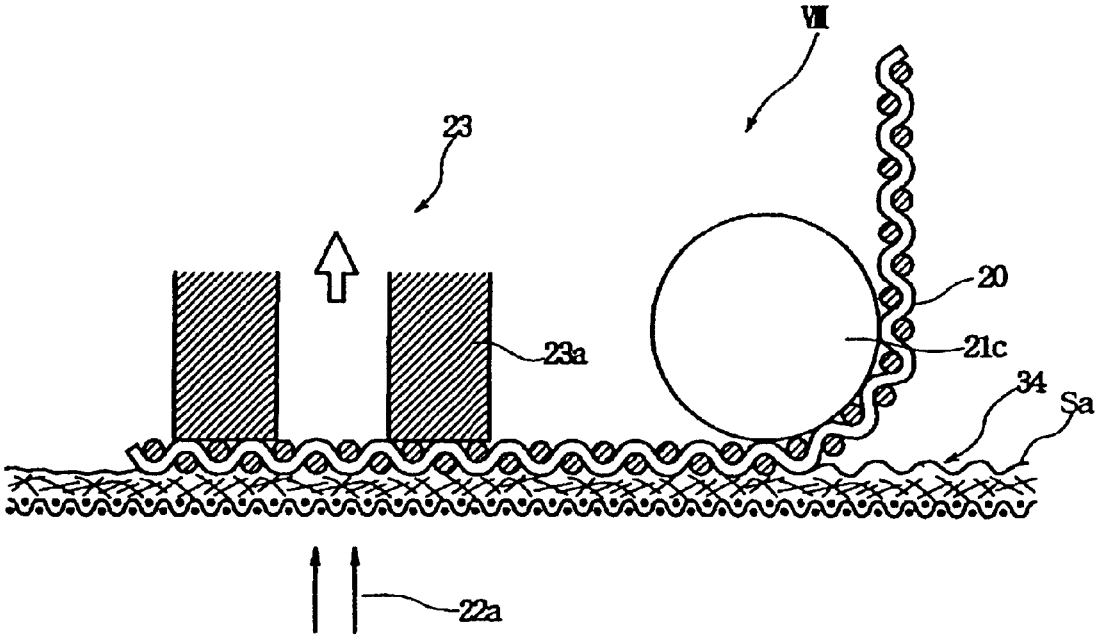
FIG. 8 is an enlarged section showing a portion of a pattern forming portion where a patterning wire and a wire net transporting belt are placed in opposition.
Figure 9A:
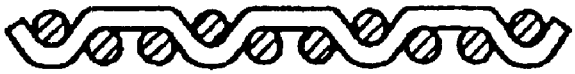
FIGS. 9A to 9F are sections showing examples of net pattern.
Figure 9B:
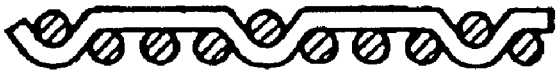
Figure 9C:
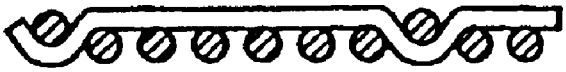
Figure 9D:
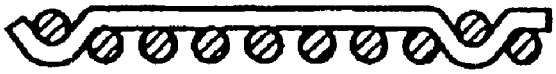
Figure 9E:
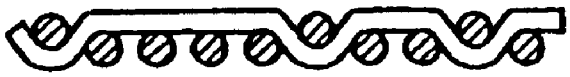
Figure 9F:
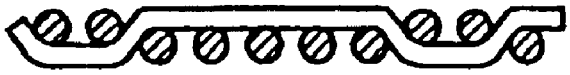

FIG. 8 is an enlarged section showing a portion where the patterning wire 20 and the wire net transporting belt 2 are placed in opposition in the pattern forming portion VIII.

The suction box 23 provided within the patterning wire has a seal member 23*a*, which slidingly contacts the inner peripheral surface of the patterning wire 20, and sucks air through the seal member 23*a* as shown by arrow.

When the spunlaced non-woven fabric S fabricated by entangling fibers in the non-woven fabric forming portion I is transported to the pattern forming portion VIII by the wire net transporting belt 2, the spunlaced non-woven fabric S is pinched between the wire net transporting belt 2 and the patterning wire 20 to move in the pattern forming portion VIII. At this time, water jets 22*a* are applied from the water jet nozzles 22 which are opposed to the inner peripheral surface of the wire net transporting belt 2. Water jets 22*a* pass through the wire net transporting belt 2 to be applied to the non-woven fabric S. Thus, with the pressure of the water jets 22*a* and suction force of the suction box 23, the non-woven fabric S is urged onto the patterning wire 20. As a result, the pattern of the patterning wire 20 is transferred on the surface of the non-woven fabric S to form the non-woven fabric sheet Sa having the pattern 34 transferred thereon.

Here, shapes of the net 33 shown in FIGS. 6 and 7 and the net (i.e., pattering wire 20) shown in FIG. 8 can be arbitrarily determine. FIGS. 9A to 9F are sections showing examples of the net pat tern suitable for use in the invention. For example, the net may have any one of the patterns shown in FIGS. 9A to 9F, but should not be limited thereto.

In the embodiment shown in FIG. 3, similarly to FIG. 1, the rollers 11 are provided in opposition to the outer peripheral surface of the wire net transporting belt 2 on downstream side of the patterning wire 20. On the other hand, the suction box 10 is provided in opposition to the inner peripheral surface of the wire net transporting belt 2. The patterned non-woven fabric sheet Sa urged onto the patterning wire 20 is peeled off the patterning wire 20 by the presence of the rollers 11 and he suction force of the suction box 10, and is also dewatered by the suction box 10.

Figure 4:
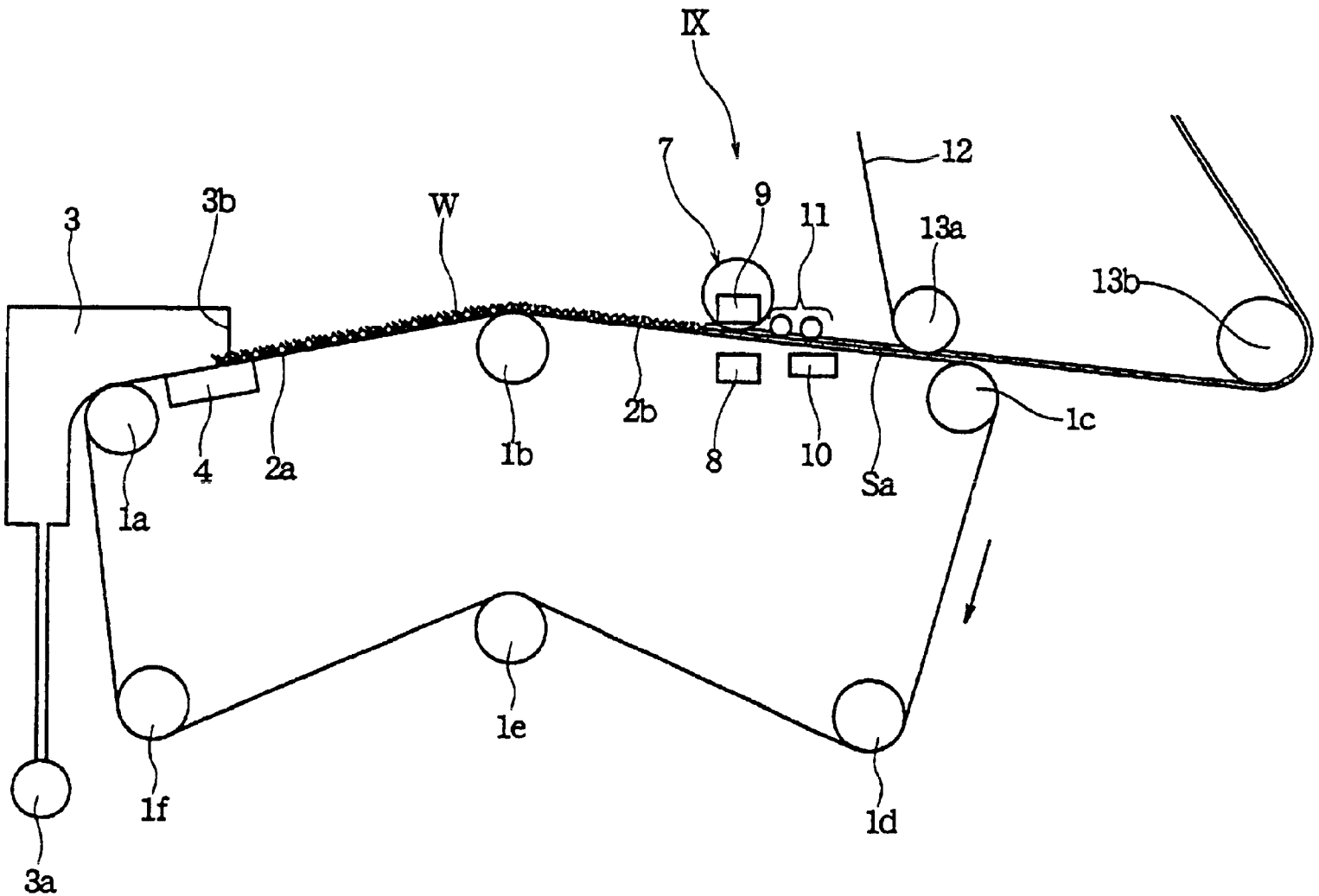
FIG. 4 is an enlarged partial illustration of a non-woven fabric manufacturing apparatus according to a third embodiment of the present invention.
Figure 5:
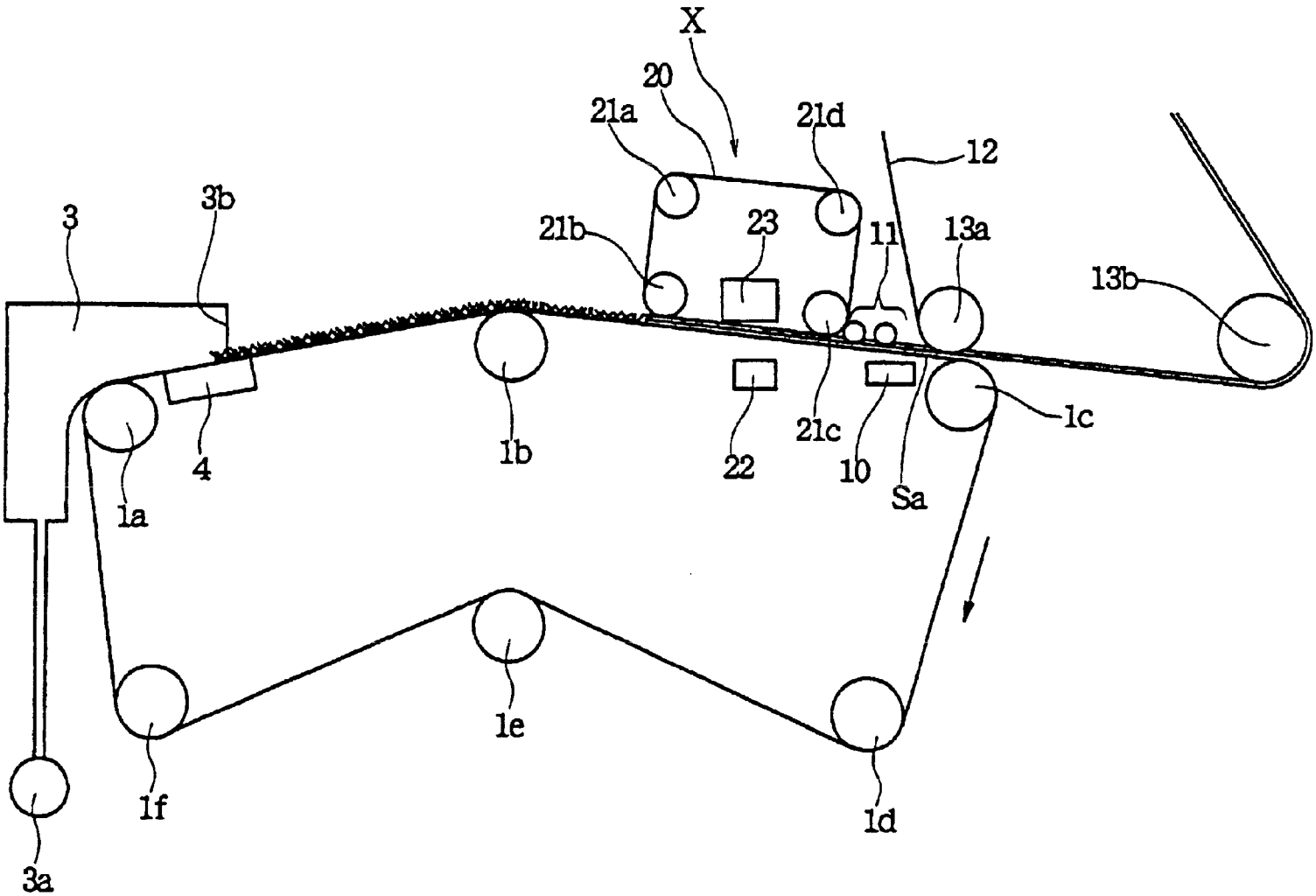
FIG. 5 is an enlarged partial illustration of a non-woven fabric manufacturing apparatus according to a fourth embodiment of the present invention.

FIGS. 4 and 5 are illustrations showing third and fourth embodiments of the present invention. In these embodiments, the water jet nozzles 5 and the suction box 6 in the non-woven fabric forming portion I shown in FIGS. 1 and 2 are eliminated, so that the portion where the pattern drum 7 or the patterning wire 20 is opposed to the water jet nozzles 8 or 22 serves as both of the non-woven fabric forming portion and the pattern forming portion. Namely, water jets are applied only from the water jet nozzles 8 or 22 to the fibrous web on the wire net transporting belt 2, so that fibers in the fibrous web are entangled with each other to form a spunlaced non-woven fabric. At the same time, the fibrous web is urged onto the pattern drum 7 or the patterning wire 20 to have the net pattern transferred thereon.

In the third embodiment of FIG. 4, a non-woven fabric and pattern forming portion IX is provided on the wire net transporting belt 2 at the position downstream of the material supply portion 3. The non-woven fabric and pattern forming portion IX has similar structure as that of the pattern forming portion II shown in FIG. 2.

The fibrous web W formed on the wire net transporting belt 2 with the gap between the wire net transporting belt 2 and the stopper member 3*b* is transported to the descending portion 2*b* of the wire et transporting belt 2 which is tilted in descending manner from the roll 1*b* to the roll 1*c*. In the non-woven fabric and pattern forming portion IX positioned between the rolls 1*b* and 1*c*, water jets 8*a* are applied to the fibrous web W from the side of the inner peripheral surface of the wire net transporting belt 2. With the pressure of the water jets 8*a* and the suction force of the suction box 9, the fibrous web W is urged onto the net 33, the drum body 31 having the openings 32, or the like. At this time, individual fibers are tightly fitted on to the net pattern or the like on the surface of the patter drum 7 while being entangled with each other. Thus, the non-woven fabric sheet Sa having the pattern 34 transferred thereon is formed.

In the fourth embodiment shown in FIG. 5, on the other hand, a non-woven fabric and pattern forming portion X is provided on the wire net transporting belt 2. The non-woven fabric and pattern forming portion X has the same construction as that of the patter forming portion VIII shown in FIG. 3.

The fibrous web W on the wire net transporting belt 2 is urged onto the patterning wire 20 by the pressure of the water jets 22*a* from the water jet nozzles 22 and the suction force of the suction box 23. At this time, individual fibers in the fibrous web W are urged onto the patterning wire 20 while being entangled with each other. Thus, the non-woven fabric sheet Sa having the pattern 34 transferred thereon is formed.

In the third and fourth embodiments, as has been described above, the transfer of the pattern is performed simultaneously with the formation of t he spunlaced non-woven fabric, without preliminarily subjecting the fibrous web to water-jet treatment before the transfer of the pattern. Therefore, the manufacturing line can be made quite short. Moreover, since the transfer of the pattern is performed simultaneously with the entanglement of fibers, the resulting non-woven fabric sheet Sa may have sufficient bulkiness to provide soft feeling to the touch. Also, after drying, the transferred pattern can be readily stored.

The manufacturing method and the manufacturing apparatus of the non-woven fabric according to the present invention may also be used upon manufacturing of a dry-laid non-woven fabric.

It should be noted that the spunlaced non-woven fabric manufactured by the method and apparatus of the present invention can be made bulky and well disintegratable (decomposable) in water by adjusting the energy of the water jets, for example. In such bulky, water-disintegratable spunlaced non-woven fabrics, fibers are entangled partially in the fibrous web or to such a degree that they merely intersect with each other, so that the non-woven fabric can be readily disintegrated by a large amount of water.

EXAMPLES

Concerning the following Example, Comparative Example 1 and Comparative Example 2, tensile strength and elongation were measured respective in MD (machine direction) and CD (cross direction) and respective in a dry condition and a wet condition.

Example

A fiber material in which 60% of NBKP (soft wood bleached kraft pulp) and 40% of rayon (1.7 dtex of fineness and 7 mm of average fiber length) were blended, was supplied on a 70 mesh wire net transporting belt. With setting travelling speed of the wire net transporting belt at 30 m/min, the water-jet treatment was performed to form a non-woven fabric having a basis weight of 50 g/m$^2$. At this time, water jets were applied at a water pressure 3920 kPa using nozzles of 100 $\mu$m of conduit diameter arrayed at 0.5 mm pitch. Thereafter, using a pattern drum having the net 33 shown FIG. 6, the net pattern was transferred. As the net 33, the net having wire pitch 4×4 mm was used. Water jets for transferring the net pattern were applied at a water pressure of 2940 kPa using nozzles of 100 $\mu$m of conduit diameter arrayed at 0.5 mm pitch.

The resulting non-woven fabric sheet having the net pattern transferred thereon had a thickness of 0.45 mm which was an average value of the heights of peaks of the undulating surface thereof.

Comparative Example 1

A fiber material having the same blending ratio as the foregoing Example was supplied on a 70 mesh wire net transporting belt. With setting travelling speed of the wire net transporting belt at 30 m/min, the water-jet treatment was performed to form a non-woven fabric having a basis weight of 50 g/m$^2$. At this time, water jets were applied at a water pressure 3920 kPa using nozzles of 100 $\mu$m of conduit diameter arrayed at 0.5 mm pitch. This non-woven fabric had a thickness of 0.3 mm, and was used as Comparative Example 1 without transferring the net pattern thereto.

Comparative Example 2

The non-woven fabric of Comparative Example 1 was embossed by pressing it using embossing rolls. One of the embossing rolls had projections for embossing, which were arranged in a polka-dot pattern at a pitch of 2 mm. Each projection had an average diameter of 1.5 mm$\phi$ and a height of 2 mm. The other embossing roll had recesses to be mated with the projections. The pressure of the embossing rolls was set at 196 kPa. This embossed sheet had a thickness of 0.45 mm which was an average value of the heights of peaks of the undulating surface thereof. The embossed sheet was used as Comparative Example 2.

Tensile strength and elongation in MD and CD in a wet condition and a dry condition are shown in the following Table 1. The measurements were conducted as follows, in accordance with a method mentioned in JIS L-1906.

The individual sheets of Example, Comparative Example 1 and Comparative Example 2 were cut to obtain a sample having a width of 25 mm and a length of 150 mm. The measurements were made on the sample using a tensilon tester with a chuck-to-chuck distance of 100 mm and tensile speed of 100 mm/min. The sample was pulled until it was broken. The strength of the sample upon maximum load was measured down to 0.1 N. This value was taken as the test result (in the following Table, unit is N/25 mm).

The elongation of the sample upon maximum load was also measured. The value derived by multiplying 100 to (length of elongation of the sample)/(original length of the sample) was taken as the test result (unit is %).

TABLE

| | | Example | Comparative Example 1 | Comparative Example 2 |
|---|---|---|---|---|
| Dry Strength | MD | 7.20 | 7.10 | 5.20 |
| (N/25 mm) | CD | 4.70 | 3.30 | 1.80 |
| Dry Elongation | MD | 5.55 | 5.58 | 7.80 |
| (%) | CD | 15.46 | 12.96 | 15.31 |
| Wet Strength | MD | 2.40 | 2.30 | 1.40 |
| (N/25 mm) | CD | 1.90 | 1.80 | 0.80 |
| Wet Elongation | MD | 18.10 | 15.70 | 18.20 |
| (%) | CD | 23.70 | 24.80 | 25.10 |

As can be clear from the foregoing Table 1, dry strength and wet strength of the embossed spunlaced non-woven fabric (Comparative Example 2) are lower than those of the spunlaced non-woven fabric (Comparative Example 1).

In contrast to the is, neither dry strength nor wet strength is lowered in Example according to the present invention.

As set forth above, according to the manufacturing method and the manufacturing apparatus of the present invention, the pattern transferred to the non-woven fabric can be well maintained, so that the entire bulkiness of the sheet is increased to provide soft feeling to the touch. When the sheet is used for cleaning or wiping operation, in addition, the transferred pattern improves the ability to wipe off fine dust, stain or the like.

On the other hand, since the pattern formation by embossing is not required after drying of the non-woven fabric, manufacturing line can be shortened.

Furthermore, by transferring the pattern on the non-woven fabric by water jets immediately after or simultaneously with formation of the non-woven fabric, the pattern can be transferred with maintaining the thickness as a whole. Therefore, the non-woven fabric having the pattern transferred thereto is allowed to have sufficient strength.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A manufacturing method of a non-woven fabric comprising the steps of:

forming a fibrous web on an outer peripheral surface of a circulating wire net transporting belt;

forming a non-woven fabric by applying water jets to said fibrous web on the outer peripheral surface of said wire net transporting belt for entangling fibers; and transporting said non-woven fabric for placement opposite to a forming body including a net having a predetermined pattern and encircling a drum body or a plurality of rolls; and applying water jets to said non-woven fabric from a side of an inner peripheral surface of said wire net transporting belt or another wire net transporting belt following said wire net transporting belt so as to urge said non-woven fabric onto said forming body to transfer said pattern of said net to said non-woven fabric, wherein a mesh of said net is sufficiently coarser than a mesh of said wire net transporting belt.

2. The manufacturing method of a non-woven fabric as set forth in claim 1, wherein said forming body is a member having a plurality of openings, and a pattern of said openings is transferred to said non-woven fabric.

3. The manufacturing method of a non-woven fabric as set forth in claim 1, wherein, in said fibrous web forming step, a raw material, in which the fibers are mixed with a liquid, is provided on said wire net transporting belt.

4. The manufacturing method of a non-woven fabric as set forth in claim 1, further comprising the step of:

drying said non-woven fabric having said pattern transferred thereto.

5. A manufacturing method of a non-woven fabric comprising the steps of:

forming a fibrous web on an outer peripheral surface of a circulating wire net transporting belt; and transporting said fibrous wet for placement opposite to a forming body including a net having a predetermined pattern and encircling a drum body or a plurality of rolls; and applying water jets to said fibrous web from a side of an inner peripheral surface of said wire net transporting belt so as to urge said fibrous web onto said forming body to simultaneously entangle fibers of said fibrous web to form the non-woven fabric and transfer said predetermined pattern of said net to said non-woven fabric, wherein a mesh of said net is sufficiently coarser than a mesh of said wire net transporting belt.

6. The manufacturing method of a non-woven fabric as set forth in claim 5, wherein said forming body is a member having a plurality of openings, and a pattern of said openings is transferred to said non-woven fabric.

7. The manufacturing method of a non-woven fabric as set forth in claim 5, wherein, in said fibrous web forming step, a raw material, in which the fibers are mixed with a liquid, is provided on said wire net transporting belt.

8. The manufacturing method of a non-woven fabric as set forth in claim 5, further comprising the step of:

drying said non-woven fabric having said pattern transferred thereto.

* * * * *